US006684808B2

(12) United States Patent
Callahan

(10) Patent No.: US 6,684,808 B2
(45) Date of Patent: Feb. 3, 2004

(54) BOAT STABILITY AND DIRECTIONAL-CONTROL DEVICE

(76) Inventor: Steven Callahan, 61A Pine St., Ellsworth, ME (US) 04605

( * ) Notice: Subject to any disclaimer, the term of this patent is extended or adjusted under 35 U.S.C. 154(b) by 2 days.

(21) Appl. No.: 10/080,308

(22) Filed: Feb. 21, 2002

(65) Prior Publication Data

US 2002/0078872 A1 Jun. 27, 2002

Related U.S. Application Data

(63) Continuation-in-part of application No. 09/537,337, filed on Mar. 29, 2000, now Pat. No. 6,367,404.

(51) Int. Cl.[7] ..... B63B 21/48
(52) U.S. Cl. ..... 114/311
(58) Field of Search ..... 114/294, 311, 114/145 R; D12/317; 383/67, 72, 76

(56) References Cited

U.S. PATENT DOCUMENTS 578,562 A * 3/1897 Hart ..... 114/311
717,890 A * 1/1903 Miller ..... 114/311
1,117,189 A * 11/1914 Jackson ..... 114/234

(List continued on next page.)

FOREIGN PATENT DOCUMENTS

DE 0144744 * 11/1980 ..... 114/311
GB 0550546 * 1/1943 ..... 114/311
GB 2115362 A * 9/1983 ..... 114/311

OTHER PUBLICATIONS

Cruising World; "The Proactive Emergency Craft"; by Steven Callahan; Published Dec. 1995; entire article.
Tinker—The Versatile Inflatables; "Tinker Fold Away RTB—The Rigid Inflatable Boat that Folds Away"; Published prior to Apr. 2, 1999; entire article.
SWITLIK; Coastal Life Raft; Published prior to Apr. 2, 1999; entire brochure.
Practical Sailor; "Offshore Life Raft Tests"; vol. 26, No. 13; Jul. 1, 2000; entire article; 4 pages.
Avon Liferafts; 3 pages, not dated.
SCHOAFF; "Winslow Approved Offshore Life Rafts Have the Follow"; Winslow Liferaft Company; 1 page, not dated.
SWITLIK; Life Rafts; 1 page.
The Givens Buoy Life Raft; U.S. patent Nos. 3,883,913 and 4,001,905; 3 pages.
Shewmon, Inc., "Shewmon's Sea Anchor & Drogue Handbook"; 2 pages; copyright 1989; Shewmon, Inc.
Para–Anchors International; letter to Steven Callahan; 1 page, Sep. 25, 1990.
Hathaway, Reiser & Raymond, Inc.; "Galerider New Storm Survival System Proven in Force 12 seas!"; 2 pages.
Seabrake America, Inc.; "The Ultimate Drogue, Introducing the revolutionary New Collapsible Seabrake GP Drift Anchor & Drogue for your safety and comfort at sea"; chart; 2 pages.

*Primary Examiner*—S. Joseph Morano
*Assistant Examiner*—Ajay Vasudeva
(74) *Attorney, Agent, or Firm*—Adams Evans P.A.

(57) ABSTRACT

A device for providing stability and directional control to a boat. The device includes a flexible water container for being deployed from one quadrant of the boat and including opposing sides, a top and a bottom, a relatively large forwardly-directed mouth opening for capturing a predetermined large quantity of water at a predetermined rate, a relatively small aft-directed drain in the opposite end of the container for discharging aft a quantity of water at a rate substantially lower than the rate at which water is captured by the mouth, and forward attachment lines carried by the container proximate a bottom side of the mouth for securing the device in close proximity to the boat by attachment to at least one forward attachment point carried by the boat amidship with the mouth in an open condition for capturing water therein, and additional attachment lines carried by the container proximate a top side of the mouth for securing the container to the boat.

13 Claims, 6 Drawing Sheets

U.S. PATENT DOCUMENTS

| | | | | | |
|---|---|---|---|---|---|
| 1,419,464 | A | | 6/1922 | Meyer | |
| 1,575,134 | A | * | 3/1926 | Stocking | 114/234 |
| 2,531,549 | A | | 11/1950 | Boyd | |
| 2,536,682 | A | * | 1/1951 | Frieder et al. | 114/311 |
| 2,794,992 | A | | 6/1957 | Metzing | |
| 2,804,633 | A | | 9/1957 | Taylor et al. | |
| 2,818,042 | A | * | 12/1957 | Manhart | 114/311 |
| 3,131,406 | A | | 5/1964 | Cousteau et al. | |
| 3,168,751 | A | | 2/1965 | Cavaignac et al. | |
| 3,170,174 | A | | 2/1965 | Hanel | |
| 3,175,234 | A | | 3/1965 | Kutsi | |
| 3,594,834 | A | | 7/1971 | Steenson | |
| 3,659,298 | A | | 5/1972 | Edwards | |
| 3,694,836 | A | | 10/1972 | Serra | |
| 3,834,410 | A | | 9/1974 | Leibel | |
| 3,932,906 | A | | 1/1976 | Johnson | |
| 3,950,804 | A | | 4/1976 | Brumfield | |
| 4,001,905 | A | | 1/1977 | Givens | |
| 4,031,580 | A | | 6/1977 | Neumann et al. | |
| 4,057,865 | A | | 11/1977 | Trautwein | |
| 4,216,559 | A | | 8/1980 | Switlik, Jr. | |
| 4,231,131 | A | | 11/1980 | Young | |
| 4,597,355 | A | | 7/1986 | Kirby | |
| 4,671,202 | A | | 6/1987 | Johnson | |
| RE32,560 | E | | 12/1987 | Givens | |
| 4,730,573 | A | | 3/1988 | Koon | |
| 4,766,918 | A | | 8/1988 | Odekirk | |
| 4,807,555 | A | | 2/1989 | Hart | |
| 4,807,556 | A | | 2/1989 | Hillier | |
| 4,942,839 | A | | 7/1990 | Chaun | |
| 4,969,413 | A | | 11/1990 | Abernethy | |
| 5,016,556 | A | | 5/1991 | Abernethy | |
| 5,025,746 | A | * | 6/1991 | Boulter | 114/311 |
| 5,070,807 | A | | 12/1991 | Lewis | |
| 5,088,434 | A | | 2/1992 | Harding | |
| 5,183,002 | A | | 2/1993 | Parker | |
| 5,317,985 | A | | 6/1994 | Shewmon | |
| 5,342,230 | A | | 8/1994 | Louis | |
| 5,353,733 | A | | 10/1994 | Evans | |
| 5,463,971 | A | | 11/1995 | Abernethy | |
| 5,800,225 | A | | 9/1998 | Shoaff, III | |
| 5,823,283 | A | | 10/1998 | Mamonov | |
| 5,868,097 | A | | 2/1999 | Spickelmire | |
| 6,135,046 | A | * | 10/2000 | Beech | 114/311 |
| 6,367,404 | B1 | * | 4/2002 | Callahan | 114/353 |

* cited by examiner

BOAT STABILITY AND DIRECTIONAL-CONTROL DEVICE

This application is a continuation-in-part of applicant's prior patent application, Ser. No. 09/537,337, filed Mar. 29, 2000, now U.S. Pat. No. 6,367,404.

TECHNICAL FIELD AND BACKGROUND OF THE INVENTION

This invention relates to a device, referred to in this application as a "sea bag", for providing stability and directional control to small boats, including rescue and auxiliary craft. The sea bag disclosed is a flexible container capable of entrapping a significant amount of water ballast that can be deployed external to the boat so that it its forces act primarily on one quadrant of the boat, and that can be fully retrieved from the water when not in use. In bad weather, it is often desirable to enhance a boat's stability to maximize its resistance to a knockdown, capsize or pitchpole. In poor conditions, when large waves lift rudders from the water or ventilate them with entrapped air, boats also can benefit from enhanced directional control. In addition, limiting drift can save a boat from being swept ashore when conditions are bad enough to prevent it from making way offshore. Even in benign weather, many mariners can benefit from deploying devices that control the direction and speed of a vessel's drift. Such devices can keep a vessel aligned to waves in ways that enhance comfort aboard, help prevent seasickness, and/or benefit fishing or other routine activities as well as serving improved safety.

Traditionally, such devices fall into three categories: drogues, sea anchors, and water ballast. Generally, drogues and sea anchors are formed of parachute-like or conical fabric structures that entrap water to build high pressure within the vessels, and they are shaped to promote fluid laminar flow, which develops lower pressure, along the outside. High pressure within and low pressure without creates hydrodynamic drag. Some drogues, however, are solid structures, which are significantly more difficult to store if they are large enough to create sufficient drag. All drogues and sea anchors to date are attached to the boat using a single but substantial length of line (a tether or rode) and are attached to the boat at one point, though a secondary rode sometimes is employed to adjust the drag device's angle to the boat. Sea anchors are usually trailed from the boat's bow and are designed to maximize drag to "anchor" the boat to the water. Drogues are usually trailed from the boat's stern and are designed to provide some drag, though substantially less than a sea anchor, while enhancing directional control. As used in this application, the term "stern" refers to the aftermost quadrant of the vessel from which the device is deployed, "bow" refers to the quadrant of the vessel opposite the end from which the device is deployed, and "port" and "starboard" refer, respectively, to the left and right quadrants of the vessel while facing forward relative to the vessel's direction of travel with the device deployed.

Problems with both drogues and sea anchors include fouling, which usually occurs because passing waves tumble them through their bridles or twist them with their rodes, rendering them ineffective. In addition, because very high loads are generated by a sea anchor or drogue, and these loads are usually carried to the vessel on one line, lines and fittings often fail or become frozen, resulting in additional losses of effectiveness or complete losses of gear. Any failure with the rode or any single device causes the loss or ineffectiveness of the entire system. Too often, such problems have rendered these devices useless just when they are needed most. In addition, a drogue or sea anchor is usually difficult to retrieve, especially in bad weather, because the crew of the vessel must pull against large forces until all of rode is retrieved, making adjustments to drag or retrieval for unfouling virtually impossible while underway or in bad conditions.

Water ballasts are designed primarily to enhance the stability of a boat to resist heeling, knockdowns, capsizes and pitchpoles. Generally water ballast has been carried either inside the vessel in tanks or bladders, or outside in pockets. Internal systems have been employed primarily by large sailing craft to enhance sail-carrying stability. External systems have been employed primarily by inflatable life rafts on which, by industry standards, the ballast pockets are distributed symmetrically around the rafts' perimeters. The weight of contained water lends the life raft stability by increasing resistance to lifting by passing waves. Conventional external water ballast acts directly upon the craft from very close proximity and its containers to date have been attached permanently to the vessel's bottom. The problem with conventional external water ballast is that the pockets can at best be collapsed, but they are not retrievable from the water. In many conditions when maximum propulsion is desired, the pockets add considerable resistance, even if collapsed. In addition, the distribution of pockets around the entire perimeter places as much water-ballast on the "downside" or leeward side of the raft as on the upwind side facing the waves. These leeward pockets add both ballast weight and drag from the pockets on the wrong side, reducing stability by helping to "trip" the raft into a capsize. Also, with drag under the water evenly distributed, such ballast pockets give the vessel no directional stability. In numerous testimonials, life raft survivors complain about how their rafts spun in bad conditions, aggravating seasickness, detracting from efficient watch keeping, and often presenting their rafts' boarding openings to breaking waves, which further endangered the crews directly by fostering hypothermia and physical displacement of crew and gear, and endangering them indirectly by adding to the risk of loss of survival equipment.

By contrast, sea bag according to this invention is applicable to any waterborne vessel, including life rafts, lifeboats, sailing craft, motor craft, paddling craft, and rowing craft of all types. The sea bag's features include a system with a fabric container that combines the hydrodynamic drag capabilities of conventional drogues and/or sea anchors with the water-ballast capabilities of conventional ballast pockets and/or bags by also entrapping a substantial amount of water. Because the invention is attached directly to the craft and is fully deployed in very close proximity using widespread attachment points rather than being trailed on a long rode-like conventional drogues and sea anchors, it cannot be tumbled through its bridle or twisted with its rode. The sea bag further eliminates deleterious effects from carrying ballast and drag on the downwind side and applies its force to one portion of the vessel, aiding directional control and preventing the vessel from spinning.

The sea bag also is fully retrievable from the water, unlike conventional water ballast systems, allowing users to enhance drift speeds in benign conditions or whenever desired, and eliminating unnecessary stress on the boat and wear on the invention. Optional tie or hardware attachments allow users to totally remove the device from the vessel not only to eliminate the drag and ballast when desired but also to allow users to replace the unit with one of a different size to ideally control drag and stability, or to eliminate wear and environmental degradation of the device, or to allow users to deploy the device from different parts of the boat—the bow or stern or side—to position the boat at any angle to the waves or to suit other conditions and thereby enhance the user's particular stability and/or directional-control needs at any given time. In some cases and to suit some materials of manufacture, weights might be required to be installed along the bottom edge of the mouth of the container in order to enhance the quick opening of the mouth upon deployment and/or to help retain the opening of the mouth; optionally, a hoop of rigid material may be inserted in a sleeve around the mouth to the same effect.

SUMMARY OF THE INVENTION

Therefore, it is an object of the invention to provide a device that combines the beneficial characteristics of traditional drogues and sea anchors while eliminating or mitigating the problems associated with them, including fouling, loss, and the reduction of directional stability as well as difficulty of retrieval.

It is another object of the invention to aid stability to water craft in order to resist knockdowns, capsizes or pitchpoles in bad weather.

It is another object of the invention to control the speed of drift of a water craft in all weather conditions.

It is another object of the invention to aid the directional control of a water craft in all weather conditions.

It is another object of the invention to provide a boat stability device which is fully retrievable in order to enhance the watercraft's performance, reduce loads on the craft, and preserve the invention's condition whenever desirable.

It is another object of the invention to provide a boat stability device that can be attached to the boat in close proximity to eliminate any possibility of loss of function through twisting or entanglement, and to prevent loss in the case of the failure of any single attachment, and to facilitate retrieval.

These and other objects of the present invention are achieved in the preferred embodiments disclosed below by providing a device that reduces drift, lends stability and aids directional control to boats but that acts upon the vessel from close proximity while remaining fully retrievable from the water. Preferably, the invention includes a coated, reinforced, woven fabric that is both stitched and bonded with adhesive and further reinforced in areas of heaviest load, such as any seams and attachment points.

According to another preferred embodiment of the invention, the container is elongated and significantly tapered in shape, forming a slab-sided or round-sided cone with attachment points on the forward top edge.

According to another preferred embodiment of the invention, a large opening in the forward side of the container forms a mouth through which water passes as the vessel moves forward to become partially trapped in the container.

According to another preferred embodiment of the invention, a drain at the apex of the conical container allows water within the container to pass through and out of the container at a significantly slower rate than it enters to rejoin the surrounding water and promote hydrodynamic drag.

According to another preferred embodiment of the invention, a retrieval line is attached to the aft end of the device and runs loosely into the boat to which the device is attached in order to allow users to retrieve the device tail-first.

According to another preferred embodiment of the invention, the drain opening size is controlled by the use of a draw string that allows users to adjust the amount of through-flow of water and to retrieve the device.

According to another preferred embodiment of the invention, attachment points are reinforced and positioned on the top forward edge of the container.

According to another preferred embodiment of the invention, side panels, the aft ends of which form side portions of the container, extend forward and reach above the water to forward points that are significantly separated from the container-top attachment points and which help prevent the container from twisting while also pulling forward and supporting the bottom edge of the container.

According to another preferred embodiment of the invention, attachment points on the device are reinforced to carry heavy loads through the use of reinforcing patches on the material of which the invention is made, and woven webbing straps to carry attaching lines or hardware.

According to another preferred embodiment of the invention, the device is attached to the boat using short rope ties or metal hardware such as snap shackles.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENTS AND BEST MODE

Figure 1:
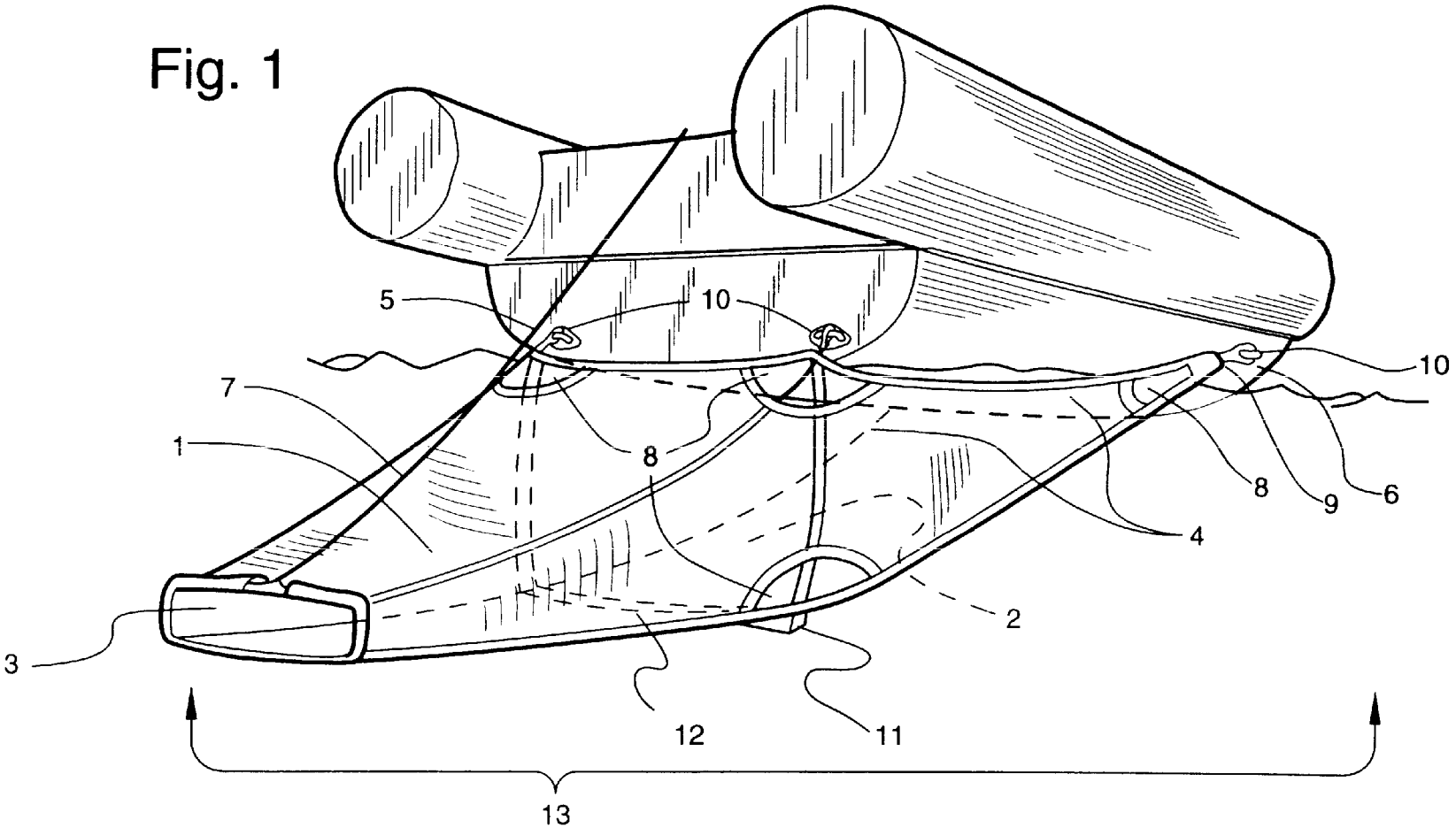
FIG. 1 is a perspective view of the preferred embodiment of the invention viewed from behind, relative to its normal direction of travel through the water, and attached to a small craft.

Referring now specifically to the drawings, a device to lend stability, control drift and aid directional stability to boats through the combined effects of water ballast and hydrodynamic drag in accordance with the present invention called a "sea bag" is shown in FIGS. 1 through 6 and shown generally at reference numeral 13. The sea bag is formed using commonly available materials and components that can be easily and inexpensively manufactured and supplied, and broadly includes a container 1, a mouth or primary opening for water entry 2, a drain or secondary, smaller opening through which water exits 3, side attachment panels 4, attachment points 5, and attachment hardware 6. Generally, the container 1 is designed with enough taper and volume to build high pressure within as water fills it while retaining a curve on its outside surfaces that promotes laminar flow of water passing by on the outside to lower pressure along its outside surfaces, thereby enhancing hydrodynamic drag.

Additionally, the container 1 is of sufficient volume to contain for some time a substantial weight of water should the boat to which it is attached become suddenly lifted from the water, although the water will slowly drain from the smaller secondary opening 3.

The invention is to be manufactured using flexible woven or film materials such as woven dacron, nylon, or similar fabrics, or PVC (polyvinylchloride), Mylar, or similar films. The preferred embodiment will be manufactured using a coated, reinforced, woven fabric that is both stitched and bonded with adhesive and further reinforced in areas of heaviest load, such as any seams and attachment points.

Figure 2:
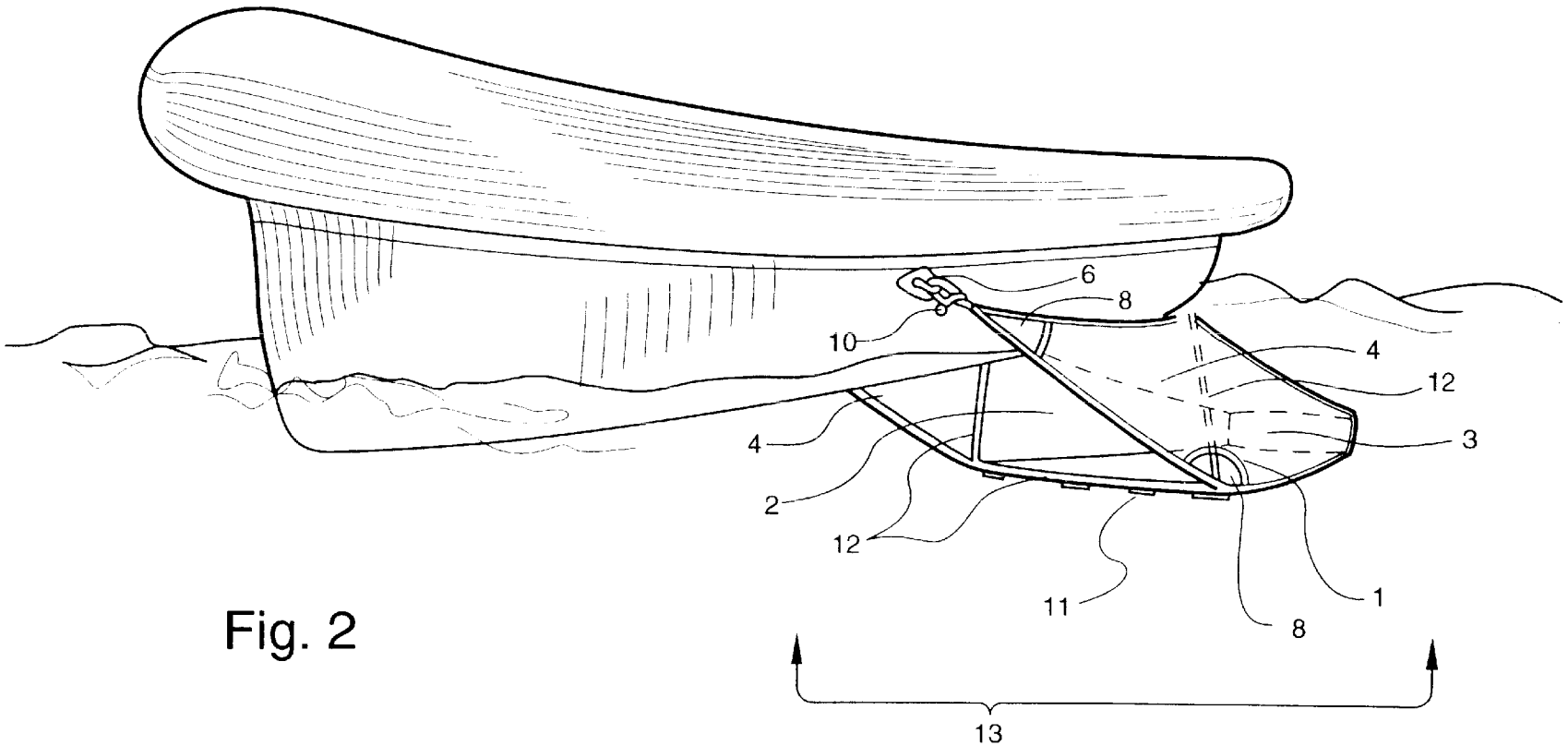
FIG. 2 is a perspective view of the preferred embodiment of the invention viewed from ahead, relative to its normal direction of travel through the water, and attached to a small craft.
Figure 3:
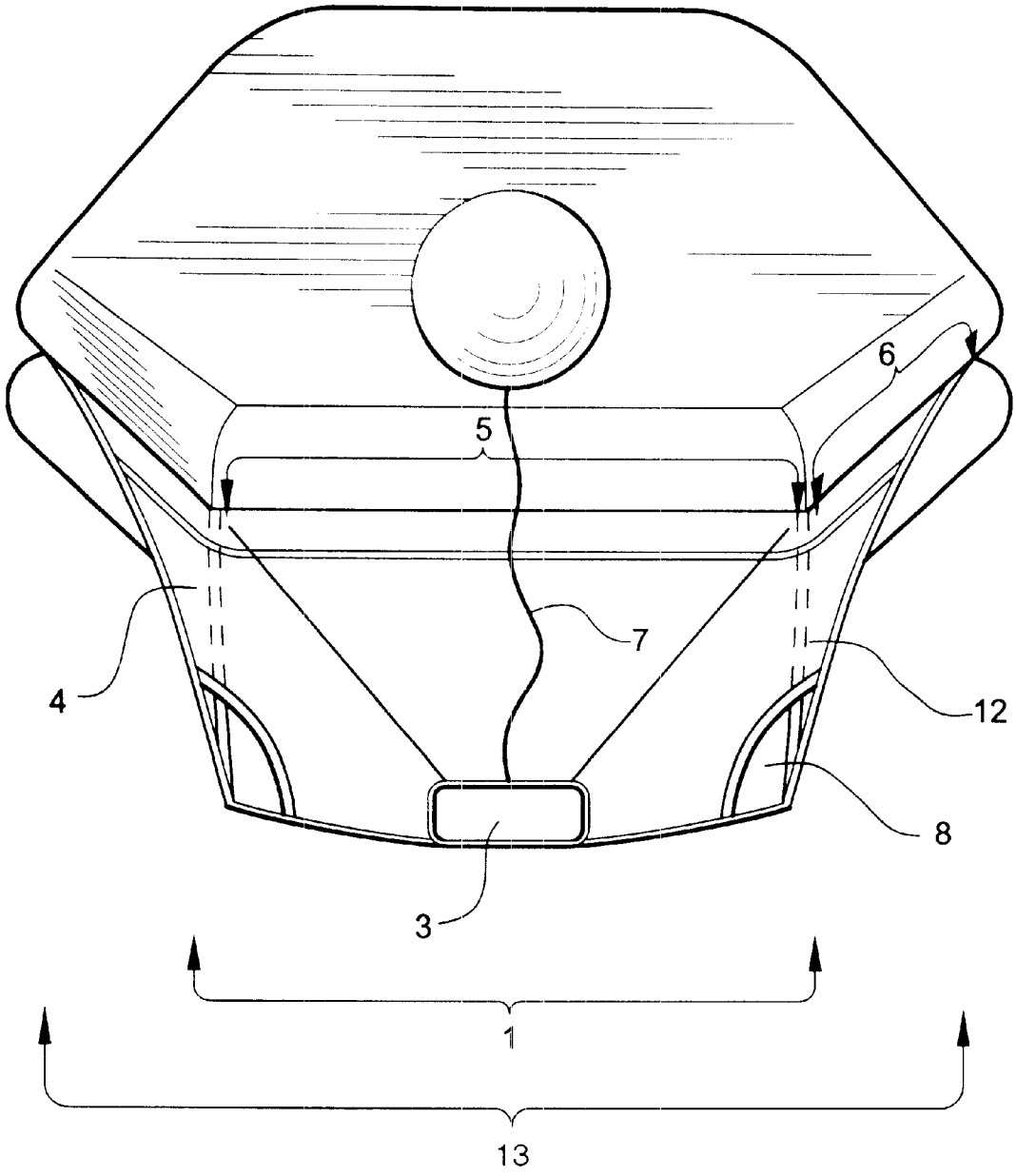
FIG. 3 is a perspective view of an optional embodiment of the invention viewed from behind, relative to its normal direction of travel through the water, showing an alternative means of attaching the invention by bonding rather than attaching with ties, short line or mechanical fasteners, as in other preferred embodiments, to a conventional life raft.
Figure 4:
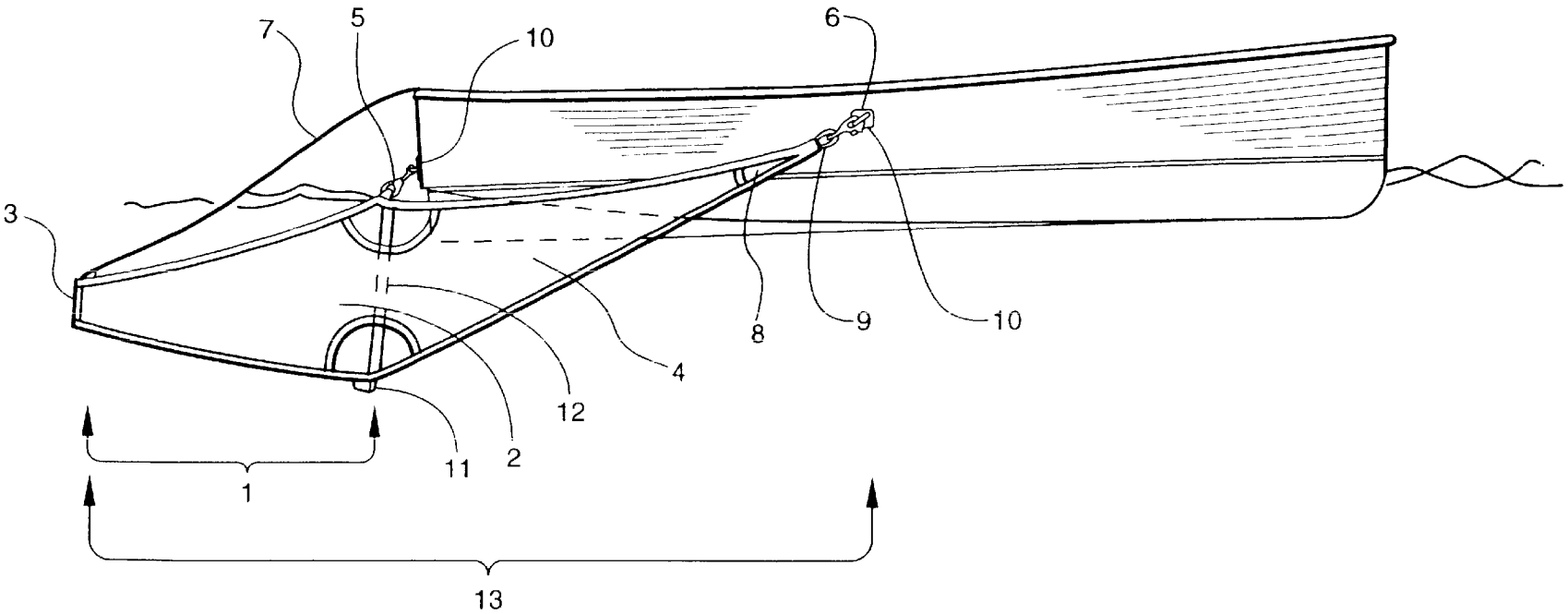
FIG. 4 is a profile view of the preferred embodiment of the invention.
Figure 5:
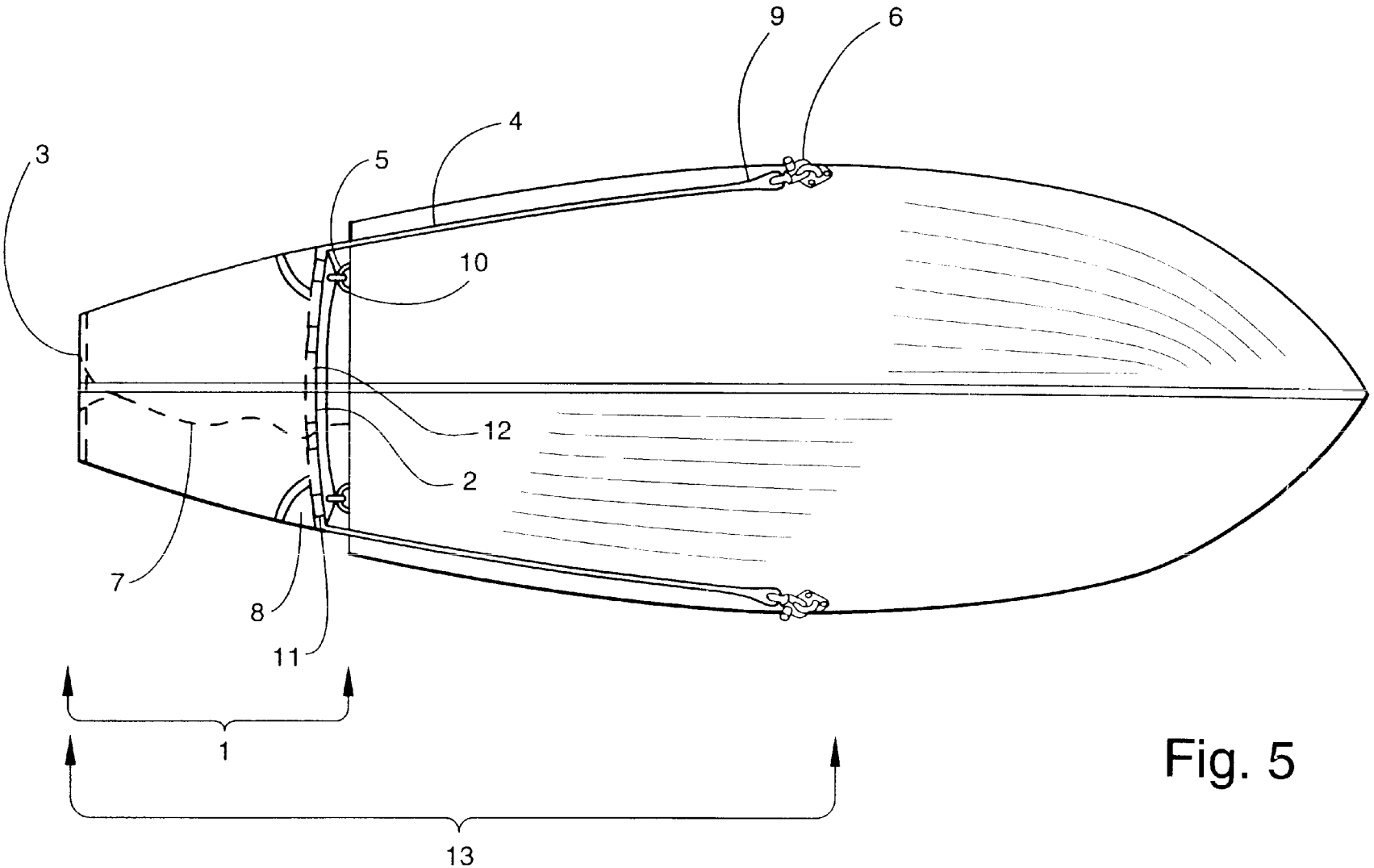
FIG. 5 is a plan view of the preferred embodiment of the invention as viewed from below.
Figure 6:
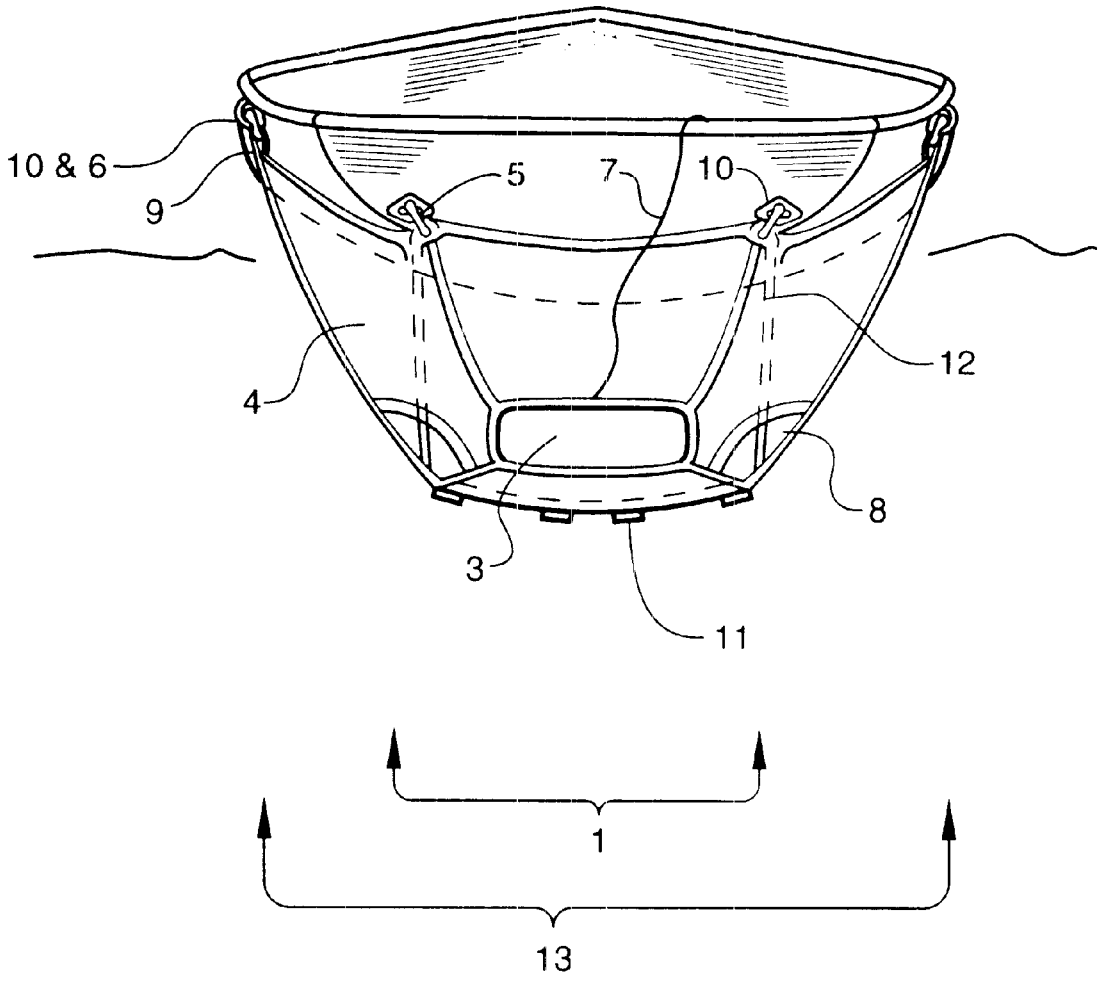
FIG. 6 is a sectional view of the preferred embodiment of the invention as seen from behind.

As shown in FIGS. 1 and 2, according to a preferred embodiment the container 1 is elongated and significantly tapered in shape, forming a slab-sided or round-sided cone with attachment points 5 on the forward top edge. A large opening in the forward side of the container 1 forms the mouth 2 through which water passes as the vessel moves forward to become partially trapped in the container 1. The drain 3 at the apex of the conical container 1 allows water within the container 1 to pass through and rejoin the surrounding water, but at a rate significantly slower than it enters the container, thereby promoting hydrodynamic drag;

A retrieval line 7 is attached to the aft end of the sea bag 13 and runs loosely into the boat to which the invention is attached in order to allow users to retrieve the invention tail-first.

The opening size of the drain 3 can be controlled by the use of the retrieval line 7 in order to allow users to adjust the amount of through-flow of water.

Preferably, the attachment points 5 are reinforced and positioned on the top forward edge of the container 1. Side panels 4, the aft ends of which form side portions of the container 1, extend forward and reach above the water to attachment points 6 that are significantly separated from the container-top attachment points 5 and which help prevent the container 1 from twisting while pulling forward and supporting the bottom edge of the container 1. The attachment points 6 are reinforced to carry heavy loads through the use of reinforcing patches 8 on the material from which the sea bag 13 is fabricated, and woven webbing straps 9 are provided to carry attaching lines or hardware 10.

According to another preferred embodiment of the invention, the sea bag 13 is attached to the boat using short rope ties or metal hardware such as snap shackles 10.

Optional features include weights 11 attached along the bottom edge of the mouth of the container 1 in order to enhance the quick opening of the mouth upon deployment and/or to help retain the opening of the mouth. A hoop of rigid rod or batten material 12 may be attached to the perimeter of the mouth to the same effect.

A device for improving stability and directional control of a boat is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A device for providing stability, reduced drift and improved directional control to a boat, comprising:

(a) a flexible water container for being attached to and deployed from opposing sides of predetermined quadrants of the boat, and including:

(i) opposing sides for attachment directly to the boat without a tether for maintaining the water container in close proximity to the boat;

(ii) a top and a bottom, wherein the top is adapted for being attached to the boat at or above a water level;

(iii) a relatively large forwardly-directed mouth opening, including top outboard extensions for capturing a predetermined large quantity of water at a predetermined rate;

(iv) a relatively small aft-directed drain in the opposite end of the container for discharging aft a quantity of water at a rate substantially lower than the rate at which water is captured by the mouth for thereby maintaining a weight of water in the water container sufficient to counteract an upward thrust of the boat;

(b) first attachment means carried by the water container proximate a bottom portion of the mouth for securing the device in close proximity to the boat by attachment to at least one forward attachment point carried by the boat with the mouth in an open condition for capturing water therein; and (c) second attachment means carried by the water container proximate a top side of the mouth for securing the container to the boat.

2. A device according to claim 1, and including a draw string positioned in the container surrounding the drain for being extendable into the boat for permitting the size of the drain opening to be varied without retrieving the device, and for removing the device from the water by first retrieving the aft-directed drain.

3. A device according to claim 1, wherein said mouth and said drain each define rectangular shapes having a lengthwise dimension extending port to starboard.

4. A device according to claim 1, and including weight means attached to the bottom of the mouth opening for aiding in holding the bottom portion of the mouth in an open position.

5. A device according to claim 1, and including a rigid hoop attached to the container around the perimeter of the mouth opening for holding the bottom portion of the mouth in an open position.

6. A device according to claim 5, wherein said hoop is selected from the group of materials consisting of rod or batten.

7. A device according to claim 1, wherein said forward attachment means include first and second lines attached to port and starboard sides of the container and for being attached to port and starboard sides of the boat.

8. A device according to claim 1, wherein said mouth is adapted for being positioned aft of the stern by less than the height of the mouth opening.

9. A device according to claim 1, wherein the length of the container from the mouth to the drain is at least twice the height of the mouth opening.

10. A device according to claim 1, and including a retrieval line for being attached by one end to the container proximate the drain and for being positionable in the boat for use by an occupant in retrieving the device.

11. A device according to claim 1, wherein the width of the mouth is no more than one-half the width of the boat at its widest point.

12. A device according to claim 1, wherein the width of the mouth is at least one-half the width of the stern of the boat.

13. A device according to claim 1, wherein the container is fully retrievable from the water when not in use.

* * * * *